US009282605B2

(12) United States Patent
Lai

(10) Patent No.: US 9,282,605 B2
(45) Date of Patent: Mar. 8, 2016

(54) DRIVER CIRCUIT FOR AT LEAST ONE LOAD AND METHOD OF OPERATING THE SAME

(71) Applicant: KONINKLIJKE PHILIPS N.V., Eindhoven (NL)

(72) Inventor: Bing Lai, Shanghai (CN)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 14/376,253

(22) PCT Filed: Feb. 8, 2013

(86) PCT No.: PCT/IB2013/051040
§ 371 (c)(1),
(2) Date: Aug. 1, 2014

(87) PCT Pub. No.: WO2013/118084
PCT Pub. Date: Aug. 15, 2013

(65) Prior Publication Data

US 2015/0028769 A1 Jan. 29, 2015

(30) Foreign Application Priority Data

Feb. 10, 2012 (CN) ..... PCT/CN2012/071003

(51) Int. Cl.
*H05B 33/08* (2006.01)

(52) U.S. Cl.
CPC ..... *H05B 33/0815* (2013.01); *H05B 33/0887* (2013.01)

(58) Field of Classification Search
CPC ..... H05B 33/0815
See application file for complete search history.

(56) References Cited

U.S. PATENT DOCUMENTS

| | | | | |
|---|---|---|---|---|
| 2007/0188114 | A1 | 8/2007 | Lys et al. | |
| 2010/0165666 | A1 * | 7/2010 | Wang et al. | 363/21.01 |
| 2010/0308733 | A1 | 12/2010 | Shao | |
| 2011/0170319 | A1 | 7/2011 | Tumminaro et al. | |
| 2011/0254457 | A1 | 10/2011 | Marent et al. | |
| 2011/0316446 | A1 * | 12/2011 | Kang et al. | 315/297 |

FOREIGN PATENT DOCUMENTS

EP 2254227 A1 11/2010

OTHER PUBLICATIONS

Fabio Cacciotto et al; "Off-line Constant Current LEDs Driver using the HVLED Primary Controller", vol. 978, No. 1, 2010 IEEE, pp. 2601-2605, Catania, Italy, Feb. 2010.
"High PFC, High Precision Off-Line White Led Driver", MT7920, MAXIC, Jan. 2012, pp. 1-7, www.macictech. com.
"Off-Line LED Driver With Primary-Sensing", HVLED805, Doc ID 18077, Oct. 2010, pp. 1-29, www.st.com.

* cited by examiner

*Primary Examiner* — Douglas W Owens
*Assistant Examiner* — Raymond R Chai

(57) ABSTRACT

A driver circuit (1) for operating at least one load, such as a LED unit (7) is provided, comprising a switching controller (5) configured to at least control a switching device (13) between the discharging and charging mode of a storage inductor, in dependence on the inductor current ($I_s$) and to control a duty cycle of the switching operation in dependence on at least one compensation signal, the compensation signal corresponding to either the input ($V_{IN}$) voltage or the output voltage ($V_{OUT}$), so that in case of a variation of the input ($V_{IN}$) or output voltage ($V_{OUT}$), the average output current, provided to the load, is maintained substantially constant.

11 Claims, 2 Drawing Sheets

DRIVER CIRCUIT FOR AT LEAST ONE LOAD AND METHOD OF OPERATING THE SAME

CROSS-REFERENCE TO PRIOR APPLICATIONS

This application is the U.S. National Phase application under 35 U.S.C. §371 of International Application No. PCT/IB13/051040, filed on Feb. 8, 2013, which claims the benefit of 35 U.S.C. §371 of International Application No. PCT/CN2012/071003, filed on Feb. 10, 2012. These applications are hereby incorporated by reference herein.

TECHNICAL FIELD

The invention relates to the field of power supply and particularly to a driver circuit for at least load, such as an LED unit, and a method of operating the same.

BACKGROUND ART

In the field of lighting, present developments aim to reduce the power consumption used for everyday lighting. For general room lighting applications, such as in residential or commercial environments, light emitting diodes (LEDs) already have become an alternative to conventional incandescent or halogen lamps. In addition to a reduced power consumption, LEDs provide the further advantage of a dramatically increased lifetime, which reduces the cost of installation and replacement.

When employing light sources comprising LEDs or similar devices, it is typically necessary to provide a constant current to the one or more LEDs since the current through an LED varies exponentially with the applied voltage. Without suitable circuitry, a variation in the voltage may easily cause overcurrent and thus damage to the LED. Accordingly, driver circuits are known in the art, limiting the current when driving an LED with a voltage source such as mains.

A general problem when using LEDs in light sources for illumination purposes, such as room lighting applications, is that the light output needs to be substantially flicker-free to provide a user, e.g. in an office environment, with a suitable work light of constant brightness. Elaborate circuit designs exist in the art, e.g. using switching mode power supplies, which allow to provide the LEDs with a correspondingly constant current, even under difficult operating conditions, such as variations in the voltage, provided by the voltage source.

However, presently available solutions typically comprise complex and thus costly circuitry, which is unsuitable for mass-market applications.

In view of the above, it is an object of the present invention to provide a versatile driver circuit for at least a load, such as a LED unit, which is cost-efficient while simultaneously providing high-quality and substantially flicker-free light output.

DISCLOSURE OF INVENTION

The object is solved by a driver circuit for operating at least one load, an LED light source and method of operating a load according to the invention. Further dependent claims relate to preferred embodiments of the invention.

The basic idea of the invention is to provide a switch-mode driver circuit of self-driving type, i.e. comprising a switching converter with a storage inductor, inductively coupled with a feedback inductor and to employ a feedback voltage, provided by said feedback inductor during operation not only for control of an inductor current through the storage inductor, but additionally for compensating variations in an input and/or output voltage of said driver circuit.

The present invention is based on the present inventors' recognition that in particular in case of driving LEDs, variations in said input and output voltage can be determined from said feedback voltage, allowing to compensate such variations without the necessity of elaborate additional circuitry or voltage sensors, providing a particularly cost-efficient setup, suitable for mass-market applications.

The present invention thus allows an improved control of the current through the at least one load, so that even in case of variations in said input and/or output voltage, an average current, provided to the load during operation, is maintained substantially constant. Accordingly, when driving LEDs, high-quality output light is provided.

The inventive driver circuit comprises at least an input for receiving an input voltage from a power supply, an output for providing an output voltage to a load, such as a LED unit, and a switching converter with at least a storage inductor and a switching device, said switching converter being disposed to generate an average output current by sequential switching operation of said switching device between at least charging mode and a discharging mode. The driver circuit further comprises a switching controller, connected at least with said switching device to control its switching operation.

The input and output may be of any suitable type to allow a connection to the power supply and the at least one load, respectively. Each of the input and output may e.g. comprise two electric terminals, such as connecting pins, solder pads, plug/socket connectors or any other suitable connector to allow a corresponding electrical connection. The connection may be permanent or temporary, the latter of which is preferred at least for the connection between power supply and input.

In the present explanation, the terms "connected" or "connection" refer to an electrical conductive connection, so that an electrical current may flow between the respectively connected devices or circuits. The connection may be direct or indirect, i.e. over intermediate components or circuits.

The input and output may comprise further components or circuits; for example, the input may comprise a rectifier and/or a smoothing stage to provide a unipolar or direct voltage to the switching converter. Correspondingly, the output may comprise for example a filter device for smoothing the voltage and/or current, delivered to the one or more loads connected. Alternatively or additionally, the input and/or output may comprise further mechanical components, for example in case the driver circuit is provided to be removed from power and/or the load, at least one correspondingly separable electrical connector or plug. Particularly in case the at least one connected load is a LED unit, it is preferred that the input and/or output is integrated with a lamp socket, connectors and/or independent flying wires with colour identifiers.

As discussed above, the input is adapted for receiving an input voltage from a power supply. The power supply may be of any suitable type, for example the power supply may be an AC mains line. The input voltage may then correspond to an alternating voltage, i.e. from a 110 V or 220 V mains connection. Alternatively, the power supply may be an electric or electronic transformer, providing a DC voltage.

The at least one electrical load may be of any suitable type. In particular, the driver circuit may be a lamp driver circuit for operating a lamp or light source, such as for example an incandescent, halogen or fluorescent lamp. Preferably, the at least one load is an LED unit. The LED unit may be of any suitable type and comprise at least one light emitting diode (LED), which in terms of the present invention may be any type of solid state light source, such as an inorganic LED, organic LED or a solid-state laser, e.g. a laser diode. The LED unit may certainly comprise more than one of the aforementioned components connected in series and/or in parallel. During operation of the inventive driver circuit, a series and/or a parallel connection of multiple LED units may be connected to the output, e.g. over intermediate components such as a buffer stage.

For general illumination purposes, the LED unit may preferably comprise at least one high-power LED, i.e. having a high current rating of up to 1 A at a relatively low voltage of e.g. 3V. Preferably said high-power LED provides a luminous flux of more than 50 lm.

The LED unit may certainly comprise further electric, electronic or mechanical components, such as a controller, e.g. to set brightness and/or colour, a smoothing stage, and/or one or more filter capacitors.

The driver circuit according to the invention further comprises the switching converter, as mentioned above. The switching converter comprises at least a storage inductor and a switching device. The switching converter may comprise further components. The switching converter is disposed to generate said average output current by sequential switching operation of the switching device between at least a charging mode and a discharging mode. In the present explanation, the term "average output current" refers to the time-averaged current, provided to the at least one load, connected to the output during operation.

The storage inductor may be of any suitable type to store electrical energy in a magnetic field when connected with a power supply. Preferably, the storage inductor comprises one or more windings of an electrical conductor. Most preferably, the storage inductor comprises at least one coil.

The switching device may be of any suitable type to allow at least said charging and discharging mode, such as an electrical power switch. Preferably, the switching device comprises at least a transistor, most preferably a MOSFET.

As discussed in the preceding, the switching converter allows at least a charging and a discharging mode. In said charging mode, the storage inductor is connected with the input and the power supply to store electrical energy in said magnetic field. Depending on the general setup of the driver circuit, the load in the present mode may be connected with or disconnected from the input.

During the discharging mode, the storage inductor is connected with the load to provide said output voltage. Typically, the storage inductor in this mode is disconnected from the power supply. It should be noted however, that a minor idle current in the range of milliamperes may flow from the power supply to the storage inductor even in the discharging mode, e.g. below 50 mA.

The switching converter may correspond to a setup of a typical step-up and/or step-down converter. Preferably, in particular in case said load is an LED unit and said input voltage is a mains voltage, the switching converter is a step-down converter, such as a typical buck converter. Most preferably, the driver circuit is a non-isolated switch-mode driver circuit, i.e. corresponding to a driver circuit, where said output and said switching converter are connected in series to said input, e.g. without any further galvanic isolation.

The driver circuit according to the invention further comprises the switching controller, as discussed above. The switching controller may comprise any suitable discrete and/or integrated circuitry to control the switching operation of the switching device, i.e. to set the switching device from charging to discharging mode and vice versa. Accordingly, the switching controller should be connected with said switching converter and/or switching device via a suitable control connection. For reasons of further increased cost-efficiency, it is preferred that the switching controller comprises discrete components only.

According to the invention, the switching controller comprises at least a feedback inductor and a voltage compensation circuit. The feedback inductor is inductively coupled to said storage inductor to provide a feedback voltage, corresponding to the variation of the inductor current through said storage inductor during operation. The feedback inductor may be of any suitable type; preferably, the feedback inductor comprises one or more windings of an electrical conductor. Most preferably, the feedback inductor comprises at least one coil. The feedback inductor may be inductively coupled to the storage inductor by a suitable arrangement, e.g. over a common magnetic core.

According to the invention, the voltage compensation circuit is connected with said feedback inductor to determine at least one compensation signal from said feedback voltage, where said compensation signal corresponds to said input or an output voltage. The voltage compensation circuit may be of any suitable type to determine said at least one compensation signal from said feedback voltage, comprising integrated or discrete circuitry, the latter of which is preferred. The at least one compensation signal may be of any suitable analogue or digital type.

The switching controller according to the invention is configured to control said switching device between said charging and said discharging mode in dependence on said inductor current, i.e. providing an inductor current based current control. For example, the switching controller may be configured to compare said feedback voltage with predefined threshold values and to set the mode of the switching device accordingly, i.e. a "threshold" current control between defined upper and lower threshold values. Since the control of the switching operation is based on the current through the storage inductor itself, the corresponding control typically is referred to as "self-driving control" in contrast to a switching control using an oscillator, etc.

Additionally, the switching controller is configured to control a duty cycle of the switching operation in dependence of said at least one compensation signal, determined by said voltage compensation circuit, allowing to maintain the average output current, provided to the load substantially constant, even in case of a variation of said input or output voltage. In the present context, the term "substantially constant" refers to the average output current being largely independent from variations of said input and/or output voltage, i.e. variations of said voltages influence the average output current only in a much smaller magnitude.

Preferably, the variation of the average output current is smaller than 5% for a combined variation of the input voltage of 15% and a variation of the output voltage of 20%. Most preferably, the variation of the average output current is smaller than 3% for a output voltage variation of 20%. Particularly preferred, the variation of the average output current is smaller than 4% for an input voltage variation of 15%.

In particular when using the inventive driver circuit for operating a lamp, such as a LED unit, the average output current of the switching converter corresponds to the luminous output flux of the LED, i.e. the brightness, so that the present invention advantageously enables approximately constant light output even in case of variations in said input or output voltage, i.e. providing high-quality light output.

In the present context, the term "duty cycle" is understood as the time in which the switching device is in the charging mode, compared with the total time of charging and discharging mode.

As mentioned in the preceding, the present invention thus advantageously provides a constant average output current even if the input voltage, provided by the power supply, or the output voltage, i.e. the voltage at the load, varies.

A variation in the input voltage may for example occur in case of a mains connection, i.e. when the power supply is an AC mains line, due to typical line fluctuations. In the aforementioned non-isolated setup, comprising a series connection of LED unit and switching converter, such fluctuation leads to a variant voltage drop at the storage inductor with variant time during the charging mode and accordingly to an increased/decreased current consumption, i.e. a correspondingly changing luminous flux. A variation in said output voltage may for example result from a varying forward voltage of a connected LED unit. This may be for example the case when using a colour-controllable RGB LED unit or when employing the inventive driver circuit with different LED units having differing forward voltages from each other. Furthermore, the output voltage may vary when the LED unit is defective, i.e. in case some LEDs of a series connection are short-circuited. The present invention also in these cases provides a substantially constant average output current and thus provides a highly versatile driver circuit.

While it is preferred that the voltage compensation signal corresponds to the input voltage so that the average output current is maintained substantially constant in case of a variation of the input voltage, according to a development of the invention, the voltage compensation circuit is configured to determine a first and a second compensation signal from said feedback voltage. The first compensation signal corresponds to the input voltage and the second compensation signal corresponds to the output voltage. The switching controller according to the present preferred embodiment is configured to receive said first and said second compensation signal and to control the duty cycle of the switching operation in dependence of both, said first and said second compensation signal.

The present embodiment advantageously allows a further improved control since variations of both, said input voltage and said output voltage are compensated by varying the duty cycle of the switching operation and thus the average output current provided.

The switching controller in the present embodiment may be configured in addition to the aforementioned current control, to control the duty cycle based on an addition of said first and second compensation signal so that upon a variation of the input voltage or the output voltage, the duty cycle is adapted accordingly.

Preferably, the switching controller is configured so that in case said first compensation signal is increased, the duty cycle of the switching operation is decreased. According to the present embodiment, the switching controller provides a reciprocal duty cycle control based on the input voltage of the driver circuit.

The present embodiment is based on the recognition that in particular in the above mentioned non-isolated setup, in an increased input voltage leads to a substantially higher current through the LED unit due to the reduced resistance thereof, i.e. a correspondingly reduced charging time. According to the present embodiment, the duty cycle of the switching operation is thus decreased to maintain the average current delivered to the load and thus the luminous flux constant. In the alternative case of a decreased first compensation signal, the switching controller most preferably should be configured to increase the duty cycle to compensate a reduced current consumption accordingly.

Alternatively or additionally to the above, the switching controller may preferably be configured so that in case said second compensation signal is increased, the duty cycle is increased, i.e. a non-reciprocal duty cycle control based on the output voltage of the driver circuit.

Corresponding to the above, a higher output voltage, e.g. resulting from an increased forward voltage of the connected LED unit results in a decrease of the average output current, in particular in the above mentioned non-isolated setup. Since in this setup, operating power is provided to the load by the storage inductor during the discharge mode, an increased output voltage results in a faster discharge of the storage inductor and an accordingly reduced time of the discharge mode. To compensate for the resulting drop in the average output current, the duty cycle is increased. Certainly, it is preferred that furthermore, in case said second compensation signal is decreased, the duty cycle of the switching operation is decreased accordingly.

While a linear control of the duty cycle in dependence on said input and/or output voltage is preferred, a non-linear control generally may be employed in dependence of the characteristics of the load, connected to the output.

According to a further development of the present invention, the voltage compensation circuit is configured to determine said (first) compensation signal from the feedback voltage during the charging mode.

As discussed in the preceding, the feedback voltage corresponds to the variation of the inductor current, i.e. its gradient, due to the inductive coupling of said storage and feedback inductors. In the charging mode, electrical energy is stored in the magnetic field of the storage inductor by the inductor current, which in this mode is supplied by the power supply. The increase of the inductor current in the charging mode, i.e. the gradient, depends on the respective voltage applied. Accordingly, a higher or lower amplitude of the input voltage results in a differing current gradient and thus is reflected in the amplitude of the feedback voltage during the charging mode.

Alternatively or additionally, the voltage compensation circuit may be configured to determine said second compensation signal from the feedback voltage during the discharging mode.

During the discharging mode, electrical energy is delivered to the load by the storage inductor. Since the electrical characteristics of inductors provide that the device resists changes in the inductor current, a voltage is generated, until current flow through the load is possible. The generated voltage thus corresponds to the output voltage (neglecting voltage drop over eventual additional components), e.g. when driving an LED unit, to its forward voltage. Because a higher output voltage results in the storage inductor being discharged faster, the gradient of the inductor current in this mode thus depends on the output voltage, so that a change or variation in the output voltage results in a correspondingly changed amplitude of the feedback voltage.

Due to the discharging of the storage inductor in this mode, the feedback voltage may show a polarity, opposite to the polarity in the charging mode.

It is noted however, that the feedback voltage does not necessarily need to reflect the exact amplitudes of the input and output voltage, since to allow a compensation of variations of the voltages, i.e. a deviation from nominal voltages, it is sufficient that the feedback voltage reflects the variations accordingly.

The voltage compensation circuit may comprise any suitable circuitry to determine said first and/or second compensation signal in the charging and discharging mode, respectively. For example, the voltage compensation circuit may comprise one or more switches to recurrently connect the feedback inductor with corresponding signal conditioning circuits to generate said first and second voltage compensation signals accordingly. Preferably, the voltage compensation circuit comprises a positive current path to determine said first compensation signal and a negative current path to determine said second compensation signal, both of which are connected with said feedback inductor. To assure that each current path is activated only during the respective mode, each may comprise at least a diode, arranged in opposing polarity, so that during the charging mode, current is provided to the positive current path and during the discharging mode, current is provided to the negative current path only.

To provide the aforementioned current control based on the inductor current, the switching controller according to a further preferred embodiment comprises a first threshold circuit, connected with said feedback inductor and configured to set the switching device from the discharging to the charging mode when said feedback voltage corresponds to a predefined minimum current threshold.

The present embodiment provides a control based on the inductor current, as reflected by the feedback voltage. The first threshold circuit may be of any suitable type, e.g. comprising a comparator, comparing said feedback voltage with a predefined minimum voltage, corresponding to said minimum current threshold. Preferably, the predefined minimum current threshold corresponds to an inductor current of substantially 0 A (+/−10 mA), i.e. according to a feedback voltage of approximately 0V.

Additionally or alternatively and according to a development of the invention, the switching controller comprises a second threshold circuit. The second threshold circuit is configured to set the switching device to the discharging mode when a current control signal, corresponding to said inductor current, corresponds to a maximum current threshold.

The operation of the second threshold circuit corresponds to the first threshold circuit, discussed above. The second threshold circuit may be of any suitable type, e.g. comprising a comparator, comparing said current control signal with a predefined voltage, corresponding to said maximum current threshold. The current control signal may be derived from the feedback voltage, using a further feedback inductor or using separate sensing means. The maximum current threshold should be set according to the application, i.e. in dependence on the electrical specification of the load and/or the switching converter.

Preferably, the second threshold circuit is connected to said voltage compensation circuit to control the duty cycle of said switching operation by varying said current control signal and/or said maximum current threshold in dependence on said first and/or second compensation signal. Accordingly, the duty cycle is set by controlling the peak inductor current through said storage inductor.

The present embodiment provides a further simplified setup of the inventive driver circuit in particular in case the minimum current threshold is fixed, as discussed above. The duty cycle control then may be realized by providing an offset or bias to said maximum current threshold and/or the current control signal. As will be apparent to one skilled in the art, a decrease of the duty cycle may be provided by decreasing said maximum current threshold or by increasing the current control signal, accordingly.

To provide a most simple circuit setup, it is preferred that the second threshold circuit is configured to bias the maximum current threshold in dependence of said second compensation signal.

The present embodiment provides that, upon an increase of the output voltage, the duty cycle is increased accordingly, resulting in said non-reciprocal duty cycle control. The second compensation signal may e.g. provide an offset to a reference voltage, corresponding to a predefined maximum current threshold for nominal operating conditions.

In a further preferred embodiment, the second threshold circuit is configured to bias the current control signal in dependence of said first compensation signal, i.e. to provide an offset to said current control signal, corresponding to said inductor current. According to this embodiment, an offset is provided to said current control signal by said first compensation signal to provide that upon an increase of the input voltage and thus the first compensation signal, the duty cycle is decreased, i.e. providing the aforementioned reciprocal duty cycle control.

As discussed in the preceding, the current control signal may e.g. be determined from said feedback voltage. According to a further preferred embodiment, the inventive driver circuit further comprises a current sensor to determine said current control signal. The current sensor is connected in series with said storage inductor so that said current control signal corresponds to said inductor current at least during the charging mode. The current sensor may comprise any suitable circuitry, most simply, a typical current sensing resistor may be employed.

In a further preferred embodiment of the invention, the switching controller additionally comprises an open-circuit detector. The open-circuit detector is configured to compare the second compensation signal with a predefined safety voltage threshold, so that the duty cycle of the switching operation is substantially decreased in case said output voltage exceeds the predefined safety voltage threshold.

The present embodiment is particularly advantageous to address eventual danger in an open output situation, i.e. in case no load is connected to the output or the load is defective. In particular in the above mentioned non-isolated setup of the switching converter, where during the discharge mode, the storage inductor is discharged over the load, an open output state results in a dramatically increased voltage at the output, as the inductor tries to maintain the inductor current.

The present embodiment accordingly decreases the duty cycle of the switching operation to limit the average output current and thus the electrical energy provided. In the present embodiment, the term "substantially" refers to a decrease of at least 50%, preferably 90%, further preferred 92% and most preferably 95%.

According to a development of the invention, the open-circuit detector is configured to decrease the duty cycle by reducing the maximum current threshold in case the output voltage exceeds said predefined safety voltage threshold.

While the open-circuit detector may be of any suitable setup, it is preferred that the open-circuit detector is integrated with said voltage compensation circuit. In the preceding, several setups of switching converters have been discussed, suitable for use in a driver circuit according to the invention. In particular when using the driver circuit with said at least one LED unit, it is preferred that the switching converter is a tapped switching converter. According to the typical setup of a tapped switching converter, the storage inductor comprises a first and a second winding, connected in series with the switching device.

The present embodiment is particularly advantageous in case of a rather large different between the input voltage and the output voltage, such as for example the case when light emitting diodes need to be operated with mains voltage. The typical tapped switching converter setup provides an adaptation of the voltage in dependence on the winding ratio between the first and second winding. In such setup, the output during the charging mode should preferably be connected in series with the first and second winding. Most preferably, the switching converter should comprise an alternative current path, so that during the discharging mode, the output, i.e. the load, is connected to the first winding of the storage inductor.

According to a further aspect of the present invention a LED light source is provided comprising at least a driver circuit according to the invention, connected with at least one LED unit, as described above. Certainly the driver circuit and/or the LED unit may correspond to one or more of the aforementioned preferred embodiments.

Another aspect of the present invention relates to a method of operating a load, such as a LED unit, with a driver circuit, comprising an input for receiving an input voltage from a power supply, an output for connection to said load and a switching converter with at least a storage inductor connected with a switching device, said switching converter being disposed to generate an average output current by sequential switching operation between at least charging mode and a discharging mode. The driver circuit further comprises a feedback inductor, inductively coupled to said storage inductor to provide a feedback voltage, corresponding to the variation of an inductor current through said storage inductor. Furthermore, a voltage compensation circuit is connected with said feedback inductor to determine at least one compensation signal from said feedback voltage, corresponding to said input or output voltage.

According to the present aspect of the invention, the switching operation of the switching device is controlled in dependence on said inductor current and the duty cycle of the switching operation is controlled in dependence of said at least one compensation signal, so that in case of a variation of said input or output voltage, the average output current is maintained substantially constant. Certainly, the present aspect of the invention may be operated in an embodiment, corresponding to one or more of above discussed preferred embodiments.

BRIEF DESCRIPTION OF THE DRAWINGS

These and other aspects, features and advantages of the present invention will be apparent from and elucidated with reference to the description of preferred embodiments in conjunction to the enclosed figures, in which.

DESCRIPTION OF EMBODIMENTS

Figure 1:
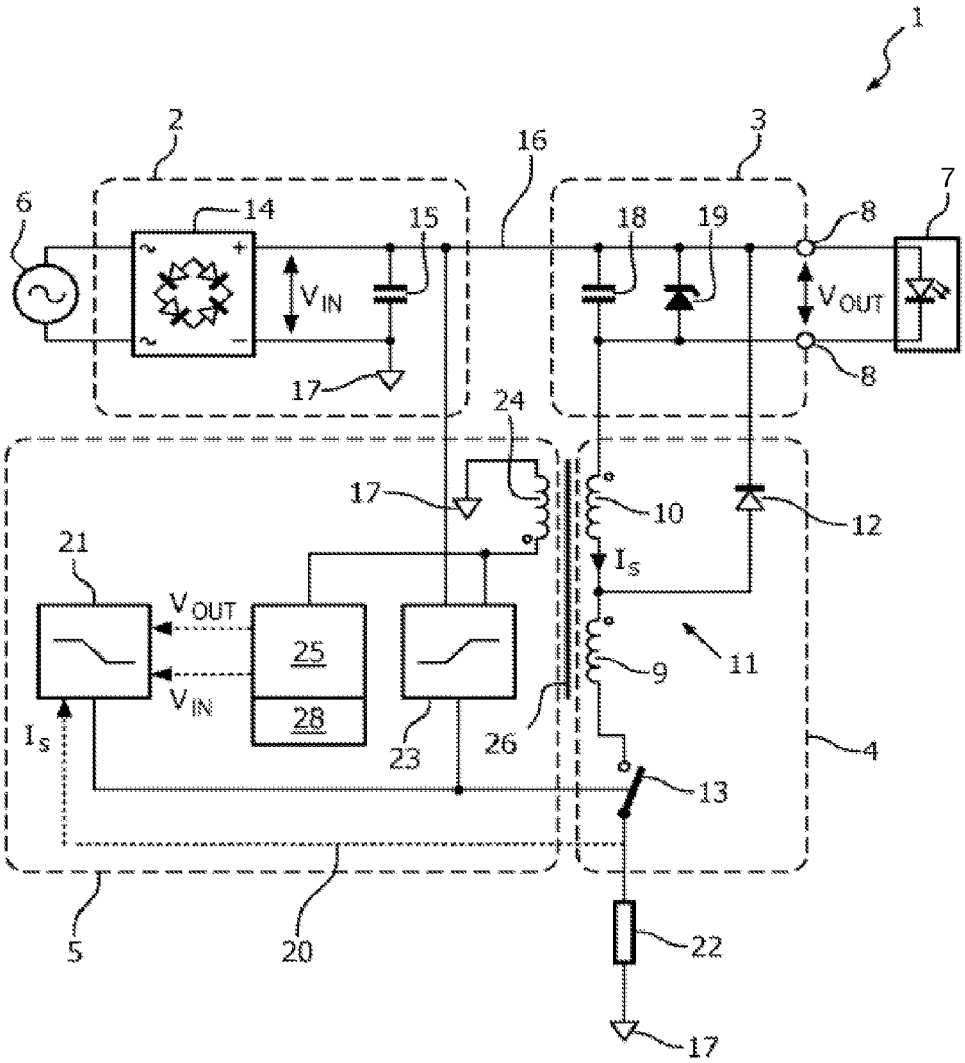
FIG. 1 shows an embodiment of a driver circuit according to the invention in a schematic block diagram and FIG. 2 shows the embodiment of FIG. 1 in a detailed circuit diagram.

FIG. 1 shows a schematic block diagram of a driver circuit 1 according to the present invention. The driver circuit 1 comprises an input 2, an output 3, a switching converter 4 and a switching controller 5. The input 2 is connected to power supply 6, which according to the present example is a 220 V or 110 V mains line and is arranged to provide an input voltage $V_{IN}$ to the driver circuit 1. The output 3 is connected to an LED unit 7 over output terminals 8, which may form a detachable connector. The LED unit 7 according to the present example comprises a number of high-power LEDs (not shown) in a series connection, resulting in an output voltage $V_{OUT}$ corresponding to the overall forward voltage of the LEDs.

Driver circuit 1 according to FIG. 1 is configured to provide an operating current to the LED unit 7 from the mains power supply 6. Since typical LEDs are driven with a voltage, substantially lower than mains voltage, the setup of driver circuit 1 according to the present example corresponds to a switching-mode step down power supply circuit.

Switching converter 4 comprises a storage inductor 11 having a primary winding 9 and a secondary winding 10. Both windings 9, 10 form coils, coupled with each other and a further feedback inductor 24 over a common magnetic core 26. The windings 9, are adapted store energy in a magnetic field when provided with power. Furthermore, switching converter 4 comprises a catch diode 12 providing an alternative current path and a switching device 13, which according to the present example is a MOSFET, controlled by switching controller 5.

As will become apparent from FIG. 1, output 3 and thus LED unit 7 is connected in series between input 2 and switching converter 4, corresponding to a typical buck converter configuration and more precisely to a so-called "tapped" buck converter configuration due to the presence of primary 9 and secondary winding 10. The tapped buck converter setup according to the present embodiment allows to provide a substantially reduced output voltage $V_{OUT}$ from a power supply 6, such as mains, while maintaining a relatively high efficiency. In such configurations, the winding ratio of secondary winding 10 and primary winding 9 should approximately match the ratio of $V_{OUT}$ to $V_{IN}$ to provide increased efficiency.

Input 2 comprises a rectifier 14, e.g. a typical bridge-type diode rectifier. A capacitor 15 is connected at the output of rectifier 14, i.e. between a DC line 16 and a ground terminal 17 to smooth the provided input voltage V. Output 3 comprises besides the aforementioned terminals 8 an electrolytic buffer capacitor 18 and a protective zener diode 19. Buffer capacitor 18 reduces current ripple during switching operations of switching converter 4. Zener diode 19 limits the voltage on terminal 8 to a safe level, e.g. in case no load is connected to terminal 8, i.e. the output 3 is in an "open" state.

In accordance with the functionality of a typical buck converter, switching device 13 is sequentially operated, i.e. set to a closed and opened state, to allow a charging mode (closed state), in which storage inductor 11 is connected in series between DC line 16 and ground terminal 17 and a discharging mode, in which the switching device 13 is opened, so that no substantial current is drawn by switching converter 4 from the power supply 6. In the charging mode, windings 9, 10 store electrical energy in corresponding magnetic fields.

During the discharging mode, the secondary winding 10 of storage inductor 11 is connected in a closed circuit with catch diode 12 and LED unit 7 so that the stored energy of windings 9, 10 is provided to the LED unit 7. Due to the common magnetic core 26, the energy of both windings 9, 10 is provided to the LED unit 7. Accordingly, LED unit 7 in the present example is supplied with operating power during both of the charging and discharging modes. Winding 9 during the discharge mode is short-circuited or simply left open.

As mentioned in the preceding, the mode of switching device 13 is set by switching controller 5. The controller 5 sets the switching device 13 according to inductor current $I_S$ and comprises a first threshold circuit 23 and a second threshold circuit 21, both connected with switching device 13. The first threshold circuit 23 sets the switching device 13 from the discharging mode to the charging mode, when the inductor current $I_S$ drops to a minimum current threshold $I_{MIN}$, e.g. in the present example 0 A. Furthermore, the first threshold circuit 23 provides initial start-up of the driver circuit 1 when connected with power supply 6.

The second threshold circuit 21 sets the switching device 13 from the charging mode to the discharging mode when the inductor current $I_S$ corresponds to a maximum current threshold $I_{MAX}$, which is set in accordance with the desired average output current.

The operation of driver circuit 1 in general corresponds to a current-control switching mode power supply. After connection of the circuit 1 with power, switching device 13 is set to the charging mode by first threshold circuit 23. The inductor current $I_s$ ramps up accordingly, supplying LED unit 7 and storage inductor 11 with power. When the inductor current $I_s$ reaches $I_{MAX}$, switching device 13 is set to the discharging mode by second threshold circuit 21. In this mode, secondary winding 10 of storage inductor 11 supplies LED unit 7 over catch diode 12 with an operating current from the energy, stored in its magnetic field during the charging mode. Accordingly, a (time-)averaged output current is provided to the LED unit 7.

Due to the switching operation on the basis of inductor current $I_s$, driver circuit 1 provides "self-driving" control without the need for, e.g. an external oscillator, rendering the present setup highly cost-efficient.

To determine, whether the inductor current $I_S$ corresponds to said maximum current threshold $I_{MAX}$, the second threshold circuit 21 is connected with the storage inductor 11 over sense connection 20 to receive a current control signal. A shunt resistor 22 is arranged so that the current control signal on sense connection 20 corresponds to the inductor current $I_S$.

Since during the discharge mode, i.e. when the switching device 13 is in its open state, no current can be determined over sense connection 20, the first threshold circuit 23 is connected to feedback inductor 24, which according to said primary and secondary winding 9, 10 is a coil with a defined number of windings of a conductor. As will be apparent from FIG. 1, feedback inductor 24 is inductively coupled to storage inductor 11 over the common magnetic core 26. Accordingly, feedback inductor 24 during operation provides a feedback voltage, which corresponds to the variation of the inductor current $I_S$.

As mentioned above, feedback inductor 24 is connected to the first threshold circuit 23, which controls the switching device 13 to the closed state when the feedback voltage drops to 0V, corresponding to a minimum current threshold of $I_{MIN}$=0A. As will be explained in more detail in the following, the change of the polarity of the feedback voltage is taken as an indication of $I_{MIN}$=0A. To allow the first threshold circuit 23 to control the mode of switching device 13, the first threshold circuit 23 is connected with DC line 16, which also provides that upon initial connection of driver circuit 1 with power supply 6, the switching operation of switching converter 4 is started. The details of the setup and the operation of threshold circuits 21, 23 will be explained with reference to FIG. 2.

While feedback inductor 24 accordingly is used to control the switching device 13 based on the inductor current $I_S$, i.e. for the above mentioned self-driving control, the feedback voltage provided by the inductor 24 during operation furthermore allows to determine variations in the input voltage $V_{IN}$ and the output voltage $V_{OUT}$, allowing to compensate such variations, which might otherwise lead to an unintended change of the provided average output current in particular when driving LEDs. Here, due to the exponential voltage/current relationship of LEDs, a variation of the voltage results in a severe change of the current though the device, which causes a change of the luminous flux of the emitted light and in the worst case, may damage the LED.

Accordingly, the feedback inductor 24 is additionally connected with a voltage compensation circuit 25. Voltage compensation circuit 25 determines variations of input voltage $V_{IN}$ and output voltage $V_{OUT}$ on the basis of the feedback voltage and provides a first and a second compensation signal, corresponding to $V_{IN}$ and $V_{OUT}$ to the second threshold circuit 21.

Both compensation signals are used by the second threshold circuit 21 to provide an offset/bias to the maximum current threshold $I_{MAX}$ and the current control signal, which will be explained in more detail with reference to FIG. 2. The corresponding "offset control" provides an adaptation of the duty cycle of the switching operation. Hence, the average output current, provided to the LED unit 7, and thus the luminous flux, is stabilised and held substantially constant independent from variations of $V_{IN}$ and $V_{OUT}$.

The operation of voltage compensation circuit 25 is based on the present inventors' recognition that the feedback voltage of the feedback inductor 24 during the charging mode corresponds to the input voltage $V_{IN}$ and during the discharging mode to the output voltage $V_{OUT}$, so that variations of said input voltage $V_{IN}$ and output voltage $V_{OUT}$ can be determined without elaborate additional sensing circuitry.

As mentioned above, during the charging mode, the inductor current $I_S$ will increase according to the input voltage $V_{IN}$ applied. Upon an increase of the input voltage $V_{IN}$, e.g. due to fluctuations of the mains line, the gradient of inductor current $I_S$ during the charging mode increases accordingly, i.e. the current will increase faster. The increased gradient of the inductor current $I_S$ results in an accordingly increased feedback voltage due to the inductive coupling and thus is a measure for the amplitude of $V_{IN}$.

Corresponding to the above, during the discharging mode, the gradient of $I_S$ depends on the output voltage $V_{OUT}$, i.e. the forward voltage of LED unit 7, since an increased/decreased output voltage $V_{OUT}$ results in the storage inductor 11 being discharged faster/slower. Accordingly, the feedback voltage in the discharging mode corresponds to the output voltage $V_{OUT}$.

It is noted, that the feedback voltage does not necessarily reflect the absolute amplitudes of the input and output voltages $V_{IN}$ and $V_{OUT}$. However, since as mentioned above, voltage compensation circuit 25 is provided to determine variations of $V_{IN}$ and $V_{OUT}$, i.e. deviations from nominal operational levels, the absolute amplitudes are of only little importance.

In addition to the above compensation of variations of $V_{IN}$ and $V_{OUT}$, the determination of $V_{OUT}$ further allows to increase the safety of the driver circuit 1 when the output 3 is open, which in particular may be the case when the LED unit 7 fails during operation, resulting in an open circuit. In such situation, the voltage over storage inductor 11 in said discharging mode will increase dramatically, since the inductor 11 tries to resist changes in current $I_S$. While zener diode 19 protects the buffer capacitor 18 in such cases, the voltage, applied at terminals 8 might nevertheless be dangerous.

Switching controller 5 accordingly comprises an open-circuit detector 28, formed integrally with said voltage compensation circuit 25. The open-circuit detector 28 determines, whether the output voltage $V_{OUT}$ reaches a predefined safety voltage threshold and thus allows to determine a failure of the LED unit 7. Open-circuit detector 28 in such case reduces $I_{MAX}$ by at least 50% of its nominal setting and thus the average output current to a safe level.

The detailed functionality of the embodiment of the inventive driver circuit of FIG. 1 and in particular of the switching controller 5 will hereinafter be explained with reference to FIG. 2.

Figure 2:
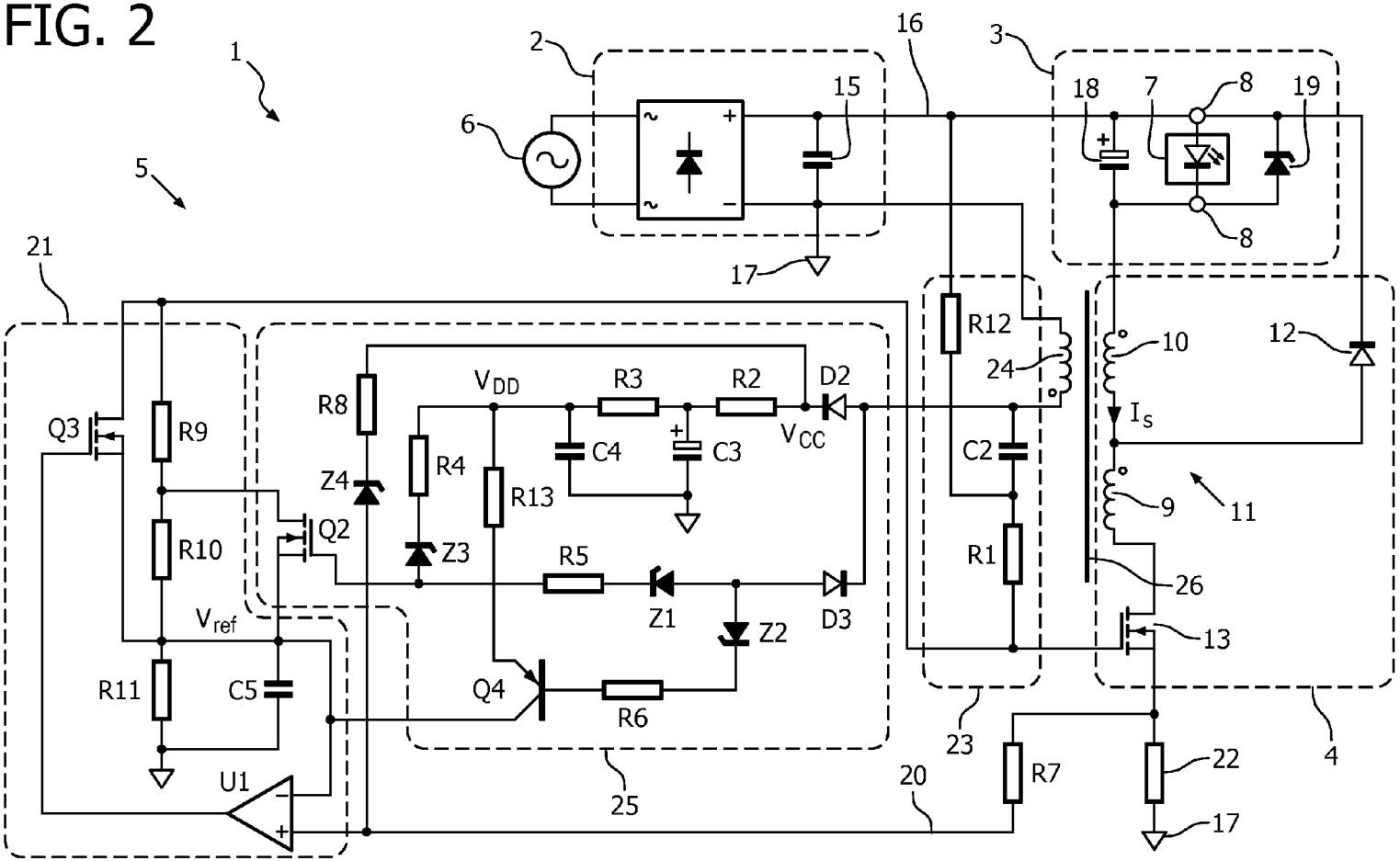

FIG. 2 shows the embodiment of FIG. 1 in a detailed circuit diagram. The reference numerals and the basic functionality of the driver circuit 1 corresponds to the above, accordingly the following explanation will be focused on the setup and functionality of the components of switching controller 5, namely first and second threshold circuits 23, 21 and voltage compensation circuit 25.

As will be apparent from the figure, first threshold circuit 23 according to the present example consists of resistors R1 and R12 and capacitor C2. Resistors R1 and R12 provide that after initial connection of the driver circuit 1 with power supply 6, an operating current is provided from DC line 16 to the gate of switching device 13 to set the switching converter 4 to the charging mode.

Inductor current $I_s$ thus increases, as mentioned in the preceding, and causes the current control signal on sense connection 20 to increase accordingly.

The current control signal is provided to comparator U1 of second threshold circuit 21, which compares the current control signal with a reference voltage $V_{REF}$.

Voltage $V_{REF}$ (DC component plus power frequency ripple voltage) corresponds to the maximum current threshold $I_{MAX}$ and is set during normal operation from gate driving voltage of MOSFET Q2 which reflects the voltage of DC line 16 over the voltage divider, formed by R1, R9 and R11. As will be explained in the following MOSFET Q2 of open-circuit detector 28 (not shown in FIG. 2) during normal operation is in a conductive state.

When the current control signal on sense connection 20 is equal to $V_{REF}$, the output of U1 enables MOSFET Q3. Accordingly, the gate of switching device 13 is connected over R11 with ground terminal 17 and correspondingly discharged, causing switching device 13 to be set to the discharging mode.

As mentioned in the preceding, during the discharging mode, current flow is maintained between secondary winding 10 and LED unit 7 over catch diode 12. Since the switching device 13 is not conductive, the current control signal on sense connection 20 will drop to zero. Accordingly the output of comparator U1 is low and resets MOSFET Q3. During the discharging mode, the feedback voltage over feedback inductor 24 will be negative due to the inverted phase points of secondary winding 10 and feedback inductor 24. Accordingly, switching device 13 will remain in the discharging mode.

At the moment, inductor current $I_S$ drops to 0 A, the storage inductor 11 will be resonant with the parasitic capacitance over drain-source of the switching device 13, which will reverse current flow. The feedback voltage over feedback inductor 24 accordingly changes its polarity and causes switching device 13 to be reset to the charging mode by the voltage provided over resistors R12 and R1 from DC line 16, so that the switching cycle is repeated.

As discussed in the preceding, feedback inductor 24 is further connected with voltage compensation circuit 25, to allow a compensation of $V_{IN}$ and $V_{OUT}$ from the feedback voltage.

The voltage compensation circuit 25 comprises a positive current path comprising diode D2, resistor R8 and zener diode Z4. Zener diode Z4 is connected with the positive input of comparator U1 and thus provides an offset to the current control signal. Due to diode D2, the positive current path is operated during the charging mode, receiving the feedback voltage, which in this mode corresponds to the input voltage $V_{IN}$. The positive current path accordingly provides the first compensation signal over Z4 to the second threshold circuit 21.

The positive path further comprises a slave power supply circuit, consisting of resistors R2, R3 and capacitors C3, C4. Resistor R2 limits the current through C3 and decouples the slave power supply from R8 and Z4, i.e. from the first compensation signal. R3 and C4 form a high frequency decoupled network for the slave power supply. The slave power supply circuit is needed in particular the operation of open-circuit detector 28.

In the charging mode, the first compensation signal is provided over the combination of resistor R8 and zener diode Z4 to comparator U1, as discussed above. Upon an increase of the input voltage $V_{IN}$, reflected by an increased feedback voltage over feedback inductor 24, the first compensation signal increases accordingly. The in this case increased offset to the current control signal on sense connection 20, which corresponds to $I_S$, leads to a reduction of the duty cycle. Accordingly, the increase of the input voltage $V_{IN}$, which would be without compensation, would lead to an increased average current through LED unit 7, is compensated by reducing the duty cycle of the switching operation, i.e. the time, in which the switching device 13 is in the charging mode. In case of a reduction of the input voltage $V_{IN}$, less current is provided over R8 and Z4, so that the duty cycle is correspondingly increased.

Voltage compensation circuit 25 further comprises a negative current path consisting of diode D3, zener diode Z2, resistor R6 and bipolar transistor Q4. The negative current path is conductive during the discharging mode since due to the discharge of secondary winding 10 in this mode, the feedback voltage, provided by feedback inductor 24 will be negative.

Transistor Q4 works in linear mode as equivalent impedance, regulated by R6, Z2 and D3. The negative current path, i.e. Q4 regulates the reference voltage $V_{REF}$, which, as mentioned in the preceding, corresponding to the maximum current threshold $I_{MAX}$. As will be apparent from FIG. 2, transistor Q4 bleeds a current from the slave power supply circuit over resistor R13, i.e. from the voltage $V_{DD}$, provided by the slave power supply circuit.

When the output voltage $V_{OUT}$ is increased, for example in case the LED unit 7 is of RGB colour-controllable type and its forward voltage is changed during operation, the thus increased feedback voltage results in the sink current in the negative current path to be increased. Consequently, transistor Q4 bleeds more current from $V_{DD}$ to $V_{REF}$, resulting in an increase of $V_{REF}$.

The increased $V_{REF}$ leads to an increase of the duty cycle. Correspondingly, the average output current, provided to the LED unit 7, is increased to compensate an increased $V_{OUT}$.

In case of a decrease of the output voltage $V_{OUT}$ the correspondingly decreased feedback voltage results in a reduction of the current through bipolar transistor Q4 and accordingly to a reduction of $V_{REF}$.

As mentioned in the preceding, voltage compensation circuit 25 further comprises open-circuit detector 28, consisting of MOSFET Q2, resistors R4, R5 and zener diodes Z1, Z3. During normal operation, the gate of Q2 is provided with an operating voltage from $V_{DD}$, i.e. from the slave power supply, over R4 and Z3. Q2 is accordingly conductive.

In case of a failure of the LED unit 7, i.e. upon an open circuit at the terminals 8, the protective diode 19 limits the voltage to its zener voltage. The thus increased output voltage $V_{OUT}$, reflected by the feedback voltage, provides a negative voltage on the negative current path, setting D3 and Z1 conductive. Accordingly, a sink current is present at the gate of Q2, which sets Q2 to a non-conductive state. Voltage reference $V_{REF}$ in this state is reduced, due to the additional resistor R10 of the voltage divider. R10 has to be selected sufficiently high. The reduction of $V_{REF}$ causes the duty cycle to be reduced significantly, so that the average output current in a "load-open" situation is accordingly reduced to increase the operational safety of driver circuit 1.

The invention has been illustrated and described in detail in the drawings and the forgoing description. Such illustration and description are to be considered illustrative or exemplary and not restrictive; the invention is not limited to the enclosed embodiments. It may for example be possible to operate the invention according to an embodiment in which:

instead of LED unit 7, a further type of load is connected to the output 3, such as a light source, e.g. an incandescent or halogen lamp, the switching converter 4, instead of the shown tapped buck converter setup corresponds to a typical buck converter or a flyback converter setup and/or feedback inductor 24 comprises two or more separate windings, inductively coupled to storage inductor 11.

Alternative variations to the disclosed embodiments can be understood and effective by those skilled in the art in practicing the claimed invention from a study of the drawings, the disclosure and the appended claims. In the claims, the word "comprising" does not exclude other elements or steps and the indefinite article "a" or "an" does not exclude a plurality. The mere fact that certain measures are recited in mutually different depended claims does not indicate that combination of these measures can not be used to advantage. Any reference since in the claims should not be construed as limiting the scope.

The invention claimed is:

1. Driver circuit for operating at least one load, such as a LED unit, the driver circuit comprising:

an input for receiving an input voltage from a power supply;

an output for providing an output voltage to said load;

a switching converter with at least a storage inductor connected with a switching device, said switching converter being disposed to generate an average output current by sequential switching operation of said switching device between at least a charging mode and a discharging mode; and a switching controller, connected with said switching device to control the switching operation of said switching device, comprising at least:

a feedback inductor, inductively coupled to said storage inductor to provide a feedback voltage, corresponding to the variation of an inductor current through said storage inductor;

a voltage compensation circuit, connected with said feedback inductor to determine at least a first compensation signal and a second compensation signal from said feedback voltage, said first compensation signal corresponding to said input voltage and said second compensation signal corresponding to said output voltage, wherein said switching controller being configured to at least control said switching device between said discharging and said charging mode in dependence on said inductor current and to control a duty cycle of the switching operation in dependence on said at least one compensation signal, so that in case of a variation of said input or output voltage, said average output current, provided to the load, is maintained substantially constant, wherein said switching controller being configured to control said duty cycle in dependence of said first and said second compensation signal;

a first threshold circuit, connected with said feedback inductor, said first threshold circuit being configured to set said switching device from said discharging mode to said charging mode when said feedback voltage corresponds to a predefined minimum current threshold;

a second threshold circuit, said second threshold circuit being configured to set the switching device to the discharging mode when a current control signal, corresponding to said inductor current, corresponds to a maximum current threshold;

wherein said second threshold circuit being connected to said voltage compensation circuit to control the duty cycle of said switching operation by varying said current control signal and/or said maximum current threshold in dependence on said first and/or second compensation signal.

2. Driver circuit according to claim 1, wherein said voltage compensation circuit is configured to determine said first compensation signal from said feedback voltage during said charging mode.

3. Driver circuit according to claim 1, wherein said voltage compensation circuit is configured to determine said second compensation signal from said feedback voltage during said discharging mode.

4. Driver circuit according to claim 1, wherein said second threshold circuit being configured to bias said maximum current threshold in dependence of said second compensation signal.

5. Driver circuit according to claim 4, wherein said second threshold circuit being configured to bias said current control signal in dependence of said first compensation signal.

6. Driver circuit according to claim 5, wherein said current control signal is determined by a current sensor, connected in series with said storage inductor.

7. Driver circuit according to claim 6, wherein said switching controller further comprises an open-circuit detector, said open-circuit detector being configured to compare said second compensation signal with a predefined safety voltage threshold, so that said duty cycle of the switching operation is substantially decreased in case said output voltage exceeds the predefined safety voltage level.

8. Driver circuit according to claim 7, wherein the open-circuit detector is configured to substantially decrease said duty cycle by reducing said maximum current threshold in case the output voltage exceeds said predefined safety voltage threshold.

9. Driver circuit according to claim 8, wherein said switching converter is a tapped switching converter.

10. LED light source comprising at least a driver circuit according to claim 7 and at least one LED unit, connected to the output of said driver circuit.

11. Method of operating a load, such as a LED unit, with a driver circuit, comprising:

receiving an input voltage from a power supply;

providing an output voltage to said load;

connecting a switching converter comprising at least a storage inductor with a switching device;

generating, by the switching converter, an average output current by sequential switching operation between at least a charging mode and a discharging mode;

inductively coupling a feedback inductor to said storage inductor to provide a feedback voltage, corresponding to the variation of an inductor current through said storage inductor;

connecting a voltage compensation circuit with said feedback inductor to determine at least one compensation signal from said feedback voltage, said compensation signal corresponds to said input voltage or said output voltage;

operating said switching device between said discharging and said charging mode in dependence of said inductor current;

controlling a duty cycle of said switching operation in dependence of said at least one compensation signal, so that in case of a variation in said input or output voltage, said average output current, provided to the load, is maintained substantially constant;

connecting said feedback inductor with a first threshold circuit;

setting, by the first threshold circuit, said switching device from said discharging mode to said charging mode when said feedback voltage corresponds to a predefined minimum current threshold;

connecting a second threshold circuit to a voltage compensation circuit;

setting, by said second threshold circuit, the switching device to the discharging mode when a current control signal, corresponding to said inductor current, corresponds to a maximum current threshold;

controlling, by said voltage compensation circuit, the duty cycle of said switching operation by varying said current control signal and/or said maximum current threshold in dependence on said first and/or second compensation signal.

* * * * *